US009207011B2

(12) United States Patent
Song et al.

(10) Patent No.: US 9,207,011 B2
(45) Date of Patent: Dec. 8, 2015

(54) FOOD CONTAINER AND REFRIGERATOR HAVING THE SAME

(71) Applicant: SAMSUNG ELECTRONICS CO., LTD., Suwon-si, Gyeonggi-do (KR)

(72) Inventors: Jin Young Song, Gwangju (KR); Yong Kyung Kim, Gwangju (KR); Sung Il Park, Gwangju (KR); Jin ha Hwang, Gwangju (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/256,284

(22) Filed: Apr. 18, 2014

(65) Prior Publication Data

US 2014/0312759 A1 Oct. 23, 2014

(30) Foreign Application Priority Data

Apr. 19, 2013 (KR) ..... 10-2013-0043306

(51) Int. Cl.

| | |
|---|---|
| ***A47B 96/04*** | (2006.01) |
| ***F25D 23/06*** | (2006.01) |
| ***F25D 25/02*** | (2006.01) |
| *F25D 23/02* | (2006.01) |

(52) U.S. Cl.

CPC ..... *F25D 23/069* (2013.01); *F25D 25/022* (2013.01); *F25D 25/025* (2013.01); *F25D 23/021* (2013.01)

(58) Field of Classification Search

CPC F25D 2325/021; F25D 25/022; F25D 25/025
USPC ..... 312/348.3, 402, 404, 408, 410; 220/534, 544, 552; 211/184
See application file for complete search history.

(56) References Cited

U.S. PATENT DOCUMENTS

| | | | | |
|---|---|---|---|---|
| 3,117,688 | A * | 1/1964 | Walstad et al. | 217/7 |
| 3,972,528 | A * | 8/1976 | McCracken et al. | 473/566 |
| 7,296,433 | B2 * | 11/2007 | Uihlein et al. | 62/441 |
| 7,997,667 | B2 * | 8/2011 | Rotter et al. | 312/402 |
| 8,733,867 | B2 * | 5/2014 | Hwang et al. | 312/402 |
| 2004/0194253 | A1 * | 10/2004 | Jung | 16/87.2 |
| 2005/0061021 | A1 | 3/2005 | Uihlein et al. | |
| 2009/0045713 | A1 * | 2/2009 | Kunkle et al. | 312/402 |
| 2010/0319391 | A1 * | 12/2010 | Lim et al. | 62/441 |

FOREIGN PATENT DOCUMENTS

| | | | |
|---|---|---|---|
| CN | 202032825 | | 11/2011 |
| EP | 2282148 | A2 | 2/2011 |
| KR | 10-2011-0079934 | * | 7/2011 |

OTHER PUBLICATIONS

English translation of Chu (KR10-2011-0079934), Mar. 12, 2015.*
Extended European Search Report dated Mar. 13, 2015 in corresponding European Patent Application No. 14165252.9.

* cited by examiner

*Primary Examiner* — Matthew Ing
(74) *Attorney, Agent, or Firm* — Staas & Halsey LLP

(57) ABSTRACT

A food container allowing the inner space of the food container to be appropriately divided with a minimum number of components and a refrigerator having the same. The food container includes a case defining an accommodation space therein, an inner surface of the case being provided with a stepped portion, a divider assembly to partition the accommodation space as desired, the divider assembly having one side slidably seated on the stepped portion.

17 Claims, 8 Drawing Sheets

FOOD CONTAINER AND REFRIGERATOR HAVING THE SAME

CROSS-REFERENCE TO RELATED APPLICATIONS

This application claims the benefit of Korean Patent Application No. 10-2013-0043306, filed on Apr. 19, 2013 in the Korean Intellectual Property Office, the disclosure of which is incorporated herein by reference.

BACKGROUND

1. Field

Embodiments of the present disclosure relate to a food container provided with a divider to appropriately partition the inner space of the food container as desired and a refrigerator having the same.

2. Description of the Related Art

A refrigerator is an appliance serving to store food products at a low temperature. Depending on the conditions of the food products, the refrigerator may store food in a cooled state or a frozen state.

As user preferences diversify and diets change, refrigerators are becoming larger and more multifunctional. Accordingly, products having various configurations are being released regarding the way of opening and closing the door and the construction of the accommodation space. For example, in the case of the doors of the refrigerators, there may be a door openable by rotating about a hinge, and a drawer type door allowing a food container connected to the door of a refrigerator to slide forward of the refrigerator to be withdrawn.

A food container to store food is connected to the interior of the drawer type door. In the case that there is no separate constituent provided to partition the inner space of the food container, food items are stacked one on another. In the case that the food items are stored in a stacked manner, a food item stored at a lower position in the food container may be damaged. In addition, the stacked items cannot be easily identified, and accordingly retrieving a desired food item may be difficult. Inconveniently, to retrieve a desired item, all the stacked items may need to be taken out of the food container.

For this reason, a divider to partition the space of the food container has been mounted to the food container. The divider has merely been arranged to divide the inner space of the food container. In this case, divided spaces have been preset regardless of the size and kinds of food, making it difficult to efficiently accommodate food. In addition, the divider may be inconvenient to use since introducing or retrieving food to be stored is substantially inconvenient.

In the case of the conventional food container, the divider has been slidably provided in the food container to address the aforementioned inconvenience. A rail unit has been mounted to an inner side surface of the food container, and the divider has been allowed to slide on the rail unit to appropriately divide the inner space of the food container as desired.

SUMMARY

Therefore, it is an aspect of the present disclosure to provide a food container allowing the inner space of the food container to be appropriately divided with a minimum number of components and a refrigerator having the same.

Additional aspects of the disclosure will be set forth in part in the description which follows and, in part, will be apparent from the description, or may be learned by practice of the disclosure.

In accordance with one aspect of the present disclosure, a food container includes a case defining an accommodation space therein, an inner surface of the case being provided with a stepped portion, and a divider assembly to partition the accommodation space as desired, the divider assembly having one side slidably seated on the stepped portion.

The divider assembly may include at least one wire divider to partition the accommodation space, a roller bracket seated on the stepped portion to slide, and a support bracket to connect the roller bracket to the wire divider.

A plurality of rollers may be mounted to the roller bracket, and the wire divider moves when the rollers are seated on the stepped portion and slide.

The at least one wire divider may include a plurality of wire dividers intersecting each other.

The at least one wire divider may include two wire dividers intersecting each other, the two wire dividers being individually movable.

A grip may be provided at a point of intersection between the two wire dividers.

The two wire dividers may be spaced apart from each other and mounted to the grip such that the two wire dividers are individually movable through manipulation of the grip.

The grip may include a first body provided with a portion of a hole allowing the wire dividers to be inserted thereinto, and a second body coupled to the first body and provided with the other portion of the hole allowing the wire dividers to be inserted thereinto.

An upper portion of the grip may be provided with a cap formed of a material producing large frictional force.

The roller bracket may be provided with a fixing part protruding therefrom, and the support bracket may be provided with a fixing hole, wherein the support bracket may be mounted to the roller bracket by inserting the fixing part into the fixing hole.

The roller bracket may be provided with an interference part, wherein one side of the support bracket may be interfered with by the interference part such that the support bracket and the roller bracket are not separated from each other.

A curved part may be formed at one side of the support bracket, and the fixing hole may be formed in the curved part, wherein the curved part may be interfered with by the interference part.

A wire insertion hole may be formed at the other side of the support bracket, wherein the wire divider may be fixed through insertion into the wire insertion hole.

A cover may be provided to an upper portion of the case.

The cover may be detachably provided to the upper portion of the case.

In accordance with another aspect of the present disclosure, a refrigerator includes a drawer type door adapted to be withdrawn forwardly, a basket connected to the drawer type door to be withdrawn when the drawer type door is withdrawn, and a food container adapted to be accommodated in the basket, an inner sidewall of the food container being provided with a stepped portion, and a divider assembly accommodated in the food container to freely partition an inner space of the food container as desired by sliding with one side thereof seated on the stepped portion.

The divider assembly may include at least one wire divider arranged across the inner space of the food container to partition the inner space of the food container, and a roller bracket connected to the wire divider, the roller bracket being seated on the stepped portion to move the wire divider by sliding.

The at least one wire divider may include two wire dividers positioned to intersect each other, wherein one of the two wire dividers is arranged to move in a direction of extension of the other one of the wire dividers.

A grip may be arranged at a point of intersection of the wire dividers, the grip being manipulated to move the wire dividers.

The roller bracket may be provided with a roller coupling portion protruding from the roller bracket and allowing a roller to be rotatably mounted, the roller moving along the stepped portion by rolling.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
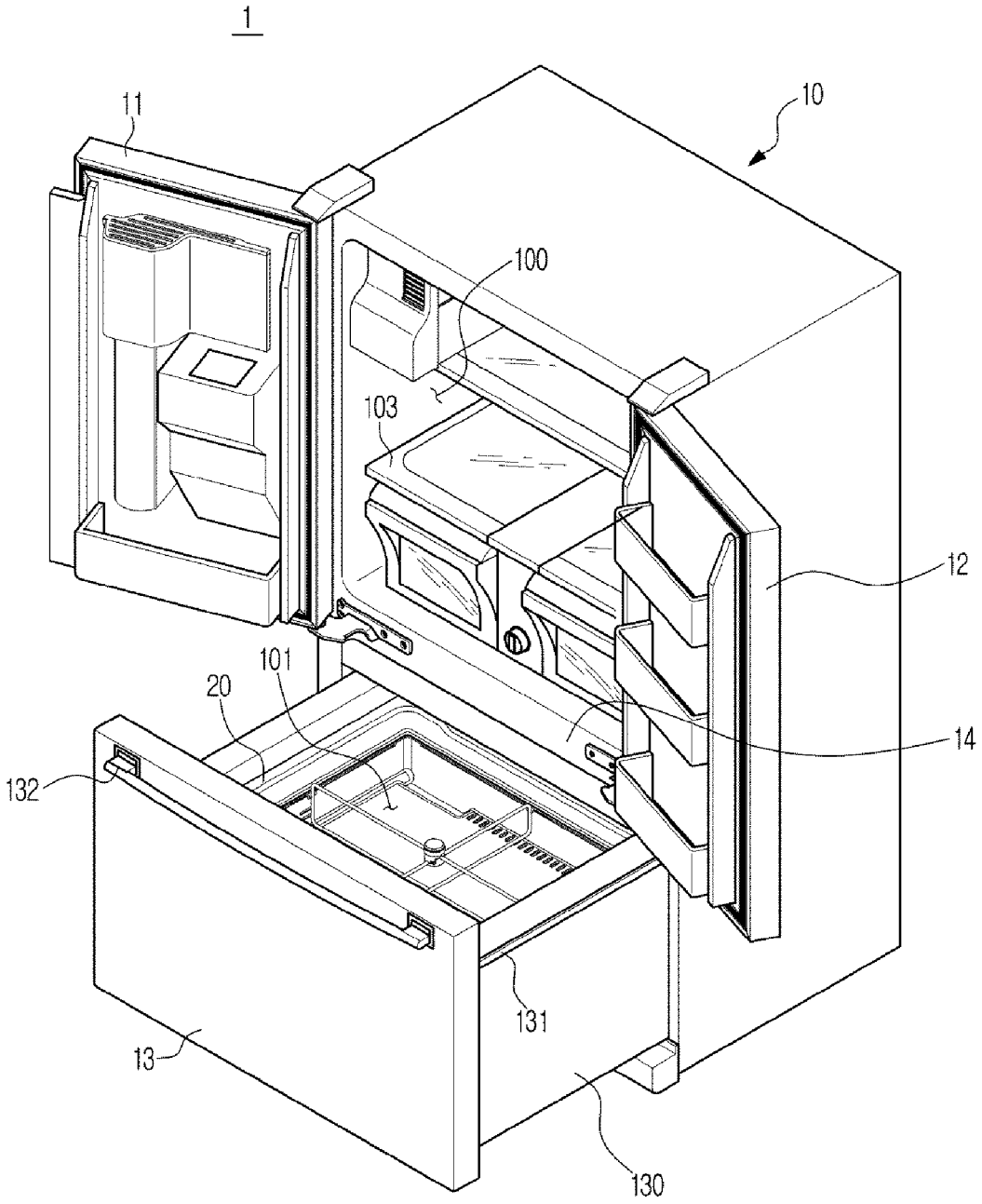
FIG. 1 is a perspective view illustrating a refrigerator according to an exemplary embodiment of the present disclosure.

Reference will now be made in detail to the embodiments of the present disclosure, examples of which are illustrated in the accompanying drawings, wherein like reference numerals refer to like elements throughout.

FIG. 1 is a perspective view illustrating a refrigerator according to an exemplary embodiment of the present disclosure.

Referring to FIG. 1, a refrigerator 1 includes a main body 10 provided with a food storage space and an opening formed at at least one side thereof and a door to open and close the opening. A partition wall 14 may be transversely disposed in the main body 10. For example, the upper storage space 100 formed by the partition wall 14 may be a fresh food compartment, and the lower storage space 101 formed by the partition wall 14 may be a freezer compartment.

The upper storage space 100 formed by the partition wall 14 may be opened and closed by rotating doors 11 and 12 that rotate about hinges, and the lower storage space 101 may be opened and closed by a drawer type door 13 withdrawable forwardly from the refrigerator 1. That is, the rotating doors 11 and 12 may be openably coupled to the front of the fresh food compartment provided to the upper storage space 100 of the refrigerator 1, and the drawer type door 13 connected to a basket 130 may be withdrawably coupled to the freezer compartment provided to the lower storage space 101 of the refrigerator 1.

The upper storage space 100 formed by the partition wall 14 may be provided with a plurality of shelves 103. As the plural shelves 103 are installed in the upper storage space 100, food products may be efficiently positioned in the upper storage space 100.

Multiple protruding seating ribs may be formed at the inner sidewalls of the main body 10, which defines the upper storage space 100. The shelves 103 may be fixed in the upper storage space 100 by being seated on the seating ribs. The shelf 103 may be withdrawable forwardly from the refrigerator 1. Thereby, the upper storage space 100 may be conveniently used by changing the positions of the shelf 103 according to food items to be stored and the size of containers.

The basket 130 may be connected to the drawer type door 13. The basket 130 may be withdrawn forwardly from the refrigerator 1 according to withdrawal of the basket 130 or introduced into the lower storage space 101. The basket 130 may accommodate a food container 20 storing food. By providing the food container 20 to the basket 130, food items may be separately and conveniently stored.

A rail unit 131 may be provided on the inner side surface of the main body 10, which defines the lower storage space 101. The side surfaces of the basket 130 may be provided with a roller unit. When the roller unit slides along the rail unit 131, the basket 130 may be withdrawn from or introduced into the lower storage space 101.

The front of the drawer type door 13 connected to the basket 130 may be provided with a handle 132. By pulling the handle 132, a user may conveniently retrieve the drawer type door 13 and the basket 130.

Hereinafter, the structure of the food container 20 accommodated in the basket 130 will be described in detail with reference to drawings.

Figure 2:
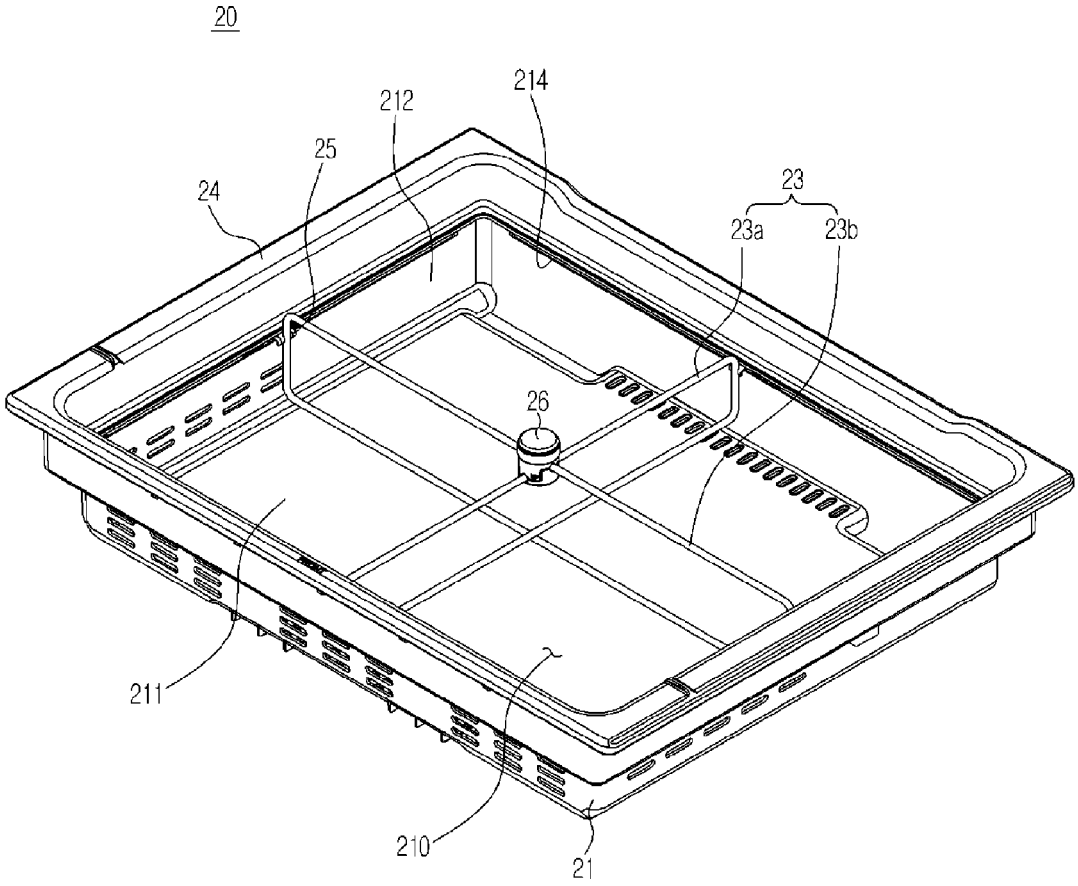
FIG. 2 is a perspective view illustrating a food container according to one embodiment of the present disclosure.
Figure 3:
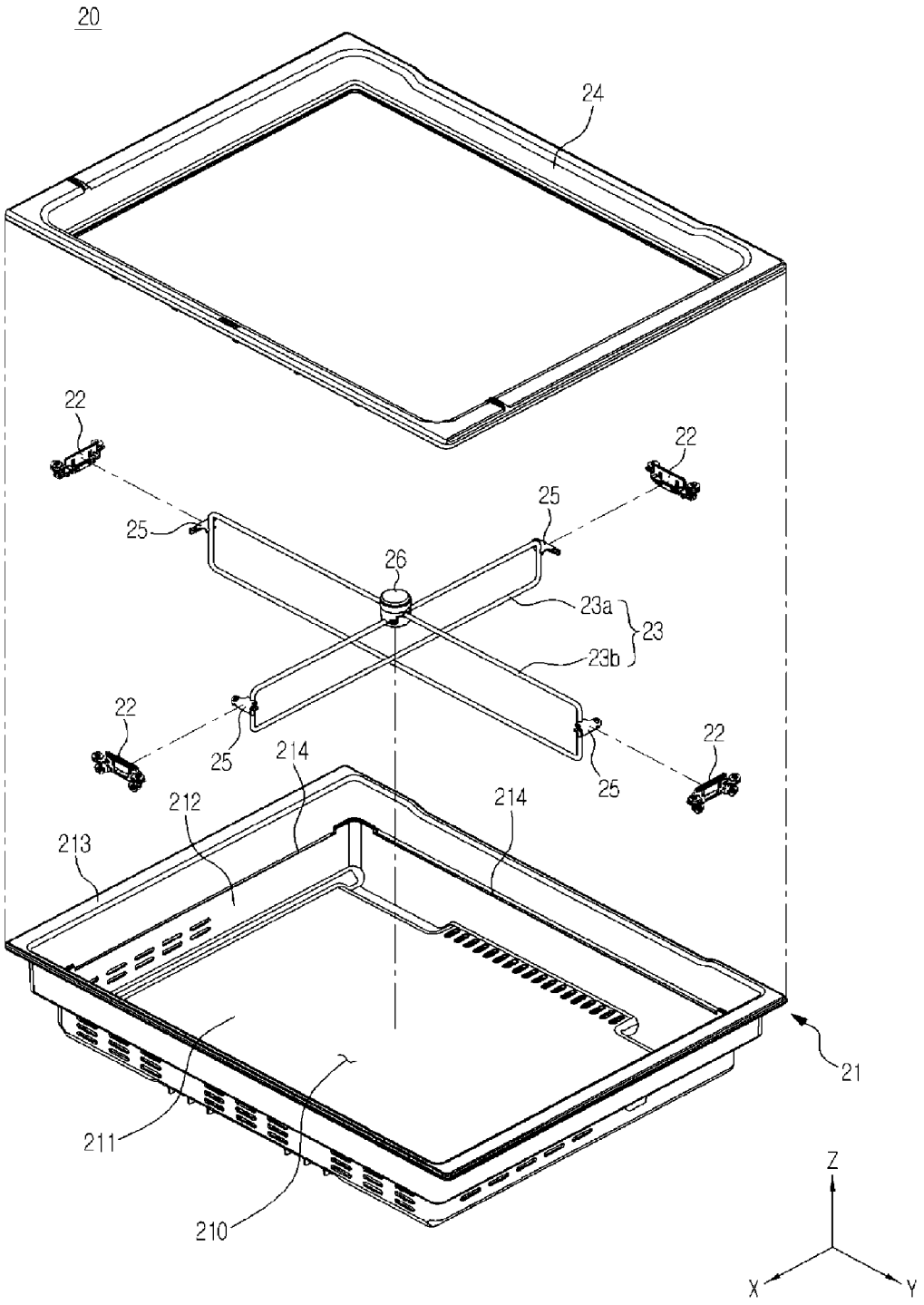
FIG. 3 is an exploded view illustrating a food container according to one embodiment of the present disclosure.

FIG. 2 is a perspective view illustrating a food container according to one embodiment of the present disclosure, and FIG. 3 is an exploded view illustrating a food container according to one embodiment of the present disclosure.

Referring to FIGS. 2 and 3, a food container 20 includes a case 21, a cover 24, and a divider assembly. The divider assembly may partition the inner space of the food container 20. As the inner space of the food container 20 is partitioned by the divider assembly, it may be efficiently used as desired.

The case 21 may be formed in a shape corresponding to that of the accommodation space formed in the basket 130. An accommodation space 210 to accommodate food may be formed in the case 21. The case 21 includes a bottom surface 211 and a sidewall 212 extending from the bottom surface 211. The accommodation space 210 of the case 21 may be formed by the bottom surface 211 and the sidewall 212. For example, the case 21 may have a quadrangular bottom surface 211, and the accommodation space 210 of the case 21 may be formed by the sidewall 212 installed at each side of the quadrangle defining the bottom surface.

An end of the sidewall 212 of the case 21 may be bent to form a catch 213. The catch 213 may be caught by the upper end of the sidewall forming the basket 130. As the catch 213 is caught by the sidewall of the basket 130, the case 21 may be accommodated in and fixed to the basket 130. The catch 213 may be formed at ends of the sidewall 212 facing each other or at all the ends of the catch 213 so as to be caught by the upper end of the sidewall of the basket 130.

A stepped portion 214 may be formed on the inner surface of the sidewall 212 of the case 21. A roller bracket 22, which will be described later, may be seated on the stepped portion 214. When seated on the stepped portion 214, the roller bracket 22 may move along the stepped portion 214. The stepped portion 214 may formed at the opposite sidewalls 212 of the case 21 facing each other or on the inner surfaces of all the sidewalls 212.

The divider assembly may be accommodated in the case 21. The accommodation space 210 in the case 21 may be partitioned by the divider assembly. The divider assembly may include a roller bracket 22, a wire divider 23, and a support bracket 25. The wire divider 23 may be movably accommodated in the accommodation space 210 of the case 21 by the roller bracket 22. As the wire divider 23 is arranged to be movable in the accommodation space 210, the accommodation space 210 may be partitioned as desired.

The cover 24 may be seated at and fixed to the upper portion of the case 21. As the cover 24 is fixed to the upper portion of the case 21, the divider assembly may be fixed so as not to escape from the case 21. In addition, the roller bracket 22 and the support bracket 25 are covered by the cover 24 such that they are not exposed, and accordingly, aesthetics of the external appearance of the food container 20 may be enhanced.

The cover 24 and the case 21 may be coupled to each other by various techniques such as hooking and fastening through fastening members. In the case that the cover 24 and the case 21 are coupled through hooking, which facilitates separation, the user may remove the divider assembly after separating the cover 24 from the case 21, and then store a food item of a large volume in the food container 20.

Hereinafter, a divider assembly according to one embodiment of the present disclosure will be described in detail with reference to the drawings.

Figure 4:
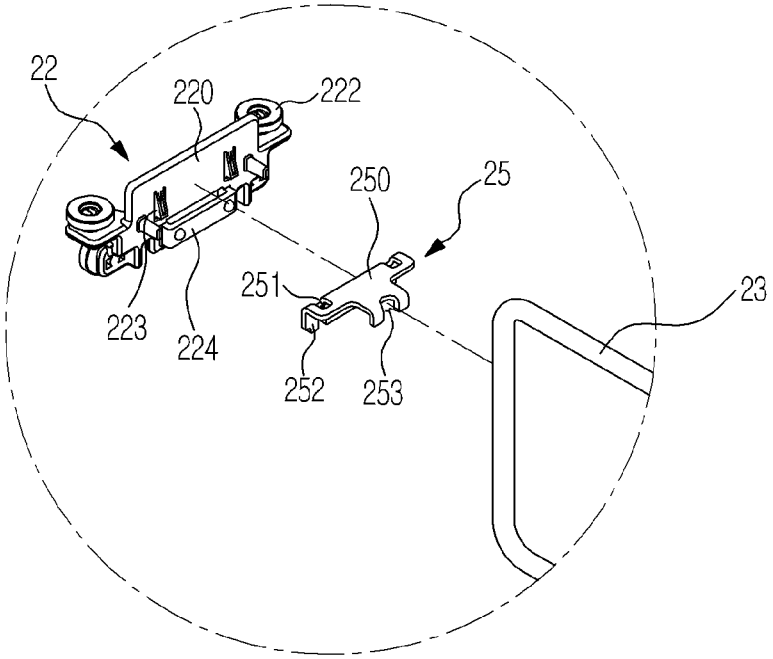
FIG. 4 is an exploded view a illustrating connection part of the divider assembly according to one embodiment of the present disclosure.
Figure 5:
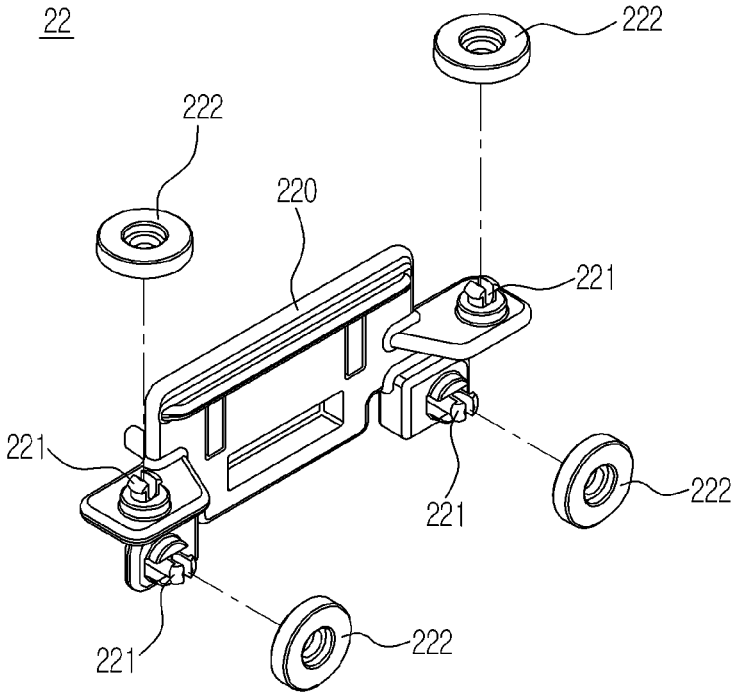
FIG. 5 is an exploded view illustrating a bracket of the divider assembly according to one embodiment of the present disclosure.
Figure 6:
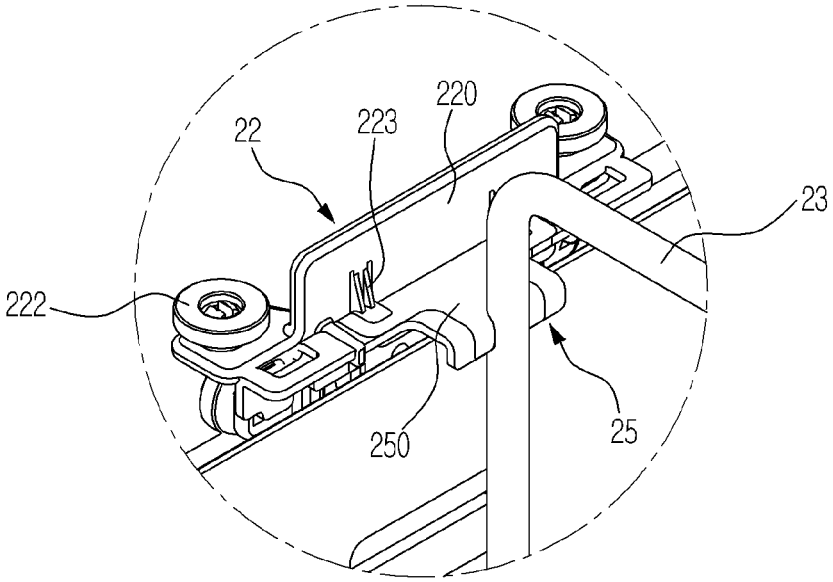
FIG. 6 is a view illustrating coupling between the wire divider and the roller bracket of the divider assembly according to one embodiment of the present disclosure.
Figure 7:
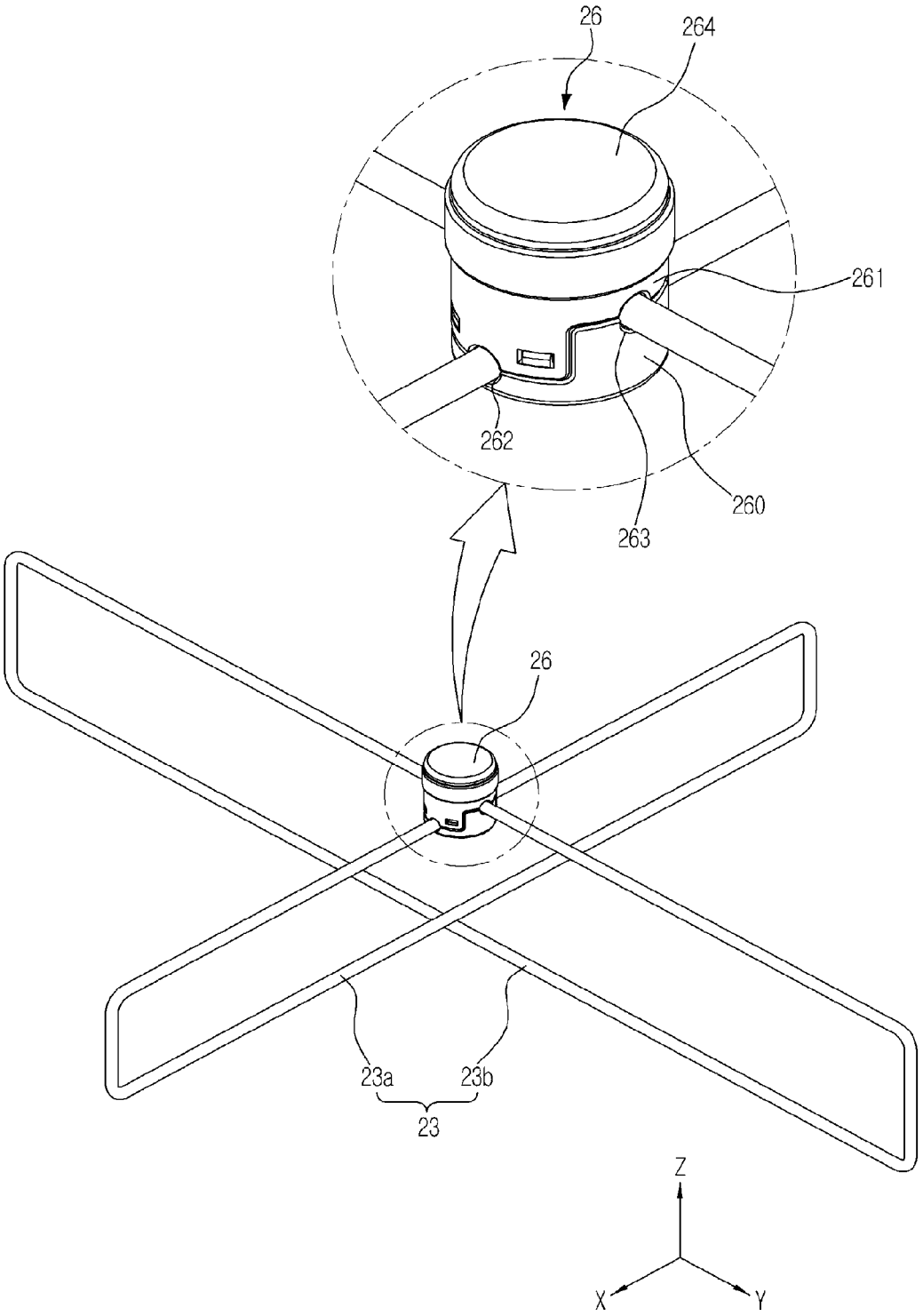
FIG. 7 is a view illustrating mounting of a grip to a wire divider according to one embodiment of the present disclosure.

FIG. 4 is an exploded view illustrating a bracket of the divider assembly according to one embodiment of the present disclosure and FIG. 5 is an exploded view illustrating a bracket of the divider assembly according to one embodiment of the present disclosure. FIG. 6 is a view illustrating coupling between the wire divider and the roller bracket of the divider assembly according to one embodiment of the present disclosure, and FIG. 7 is a view illustrating mounting of a grip to a wire divider according to one embodiment of the present disclosure.

Referring to FIGS. 4 to 7, a divider assembly according to one embodiment includes a roller bracket 22, a wire divider 23, and a support bracket 25. The wire divider 23 may be coupled to the roller bracket 22 through the support bracket 25. The roller bracket 22 may be slidably seated on the stepped portion 214 of the case 21. When the roller bracket 22 seated on the stepped portion 214 slides, the wire divider 23 may move within the accommodation space 210 of the food container 20.

The roller bracket 22 includes a body 220 and a roller 222. The roller 222 may be mounted to the body 220. The roller bracket 22 equipped with the roller 222 may be slidably seated on the stepped portion 214 of the food container 20. A plurality of rollers 222 may be provided.

A roller coupling portion 221 may be formed at the body 220 of the roller bracket 22 in a protruding manner. The roller 222 may be provided with a hole allowing the roller coupling portion 221 to pass therethrough. The roller coupling portion 221 may include at least two protrusions. The diameter of the upper end portion of the roller coupling portion 221 may be greater than the inner diameter of the hole formed in the roller 222, and the diameter of the lower end portion of the roller coupling portion 221 may be less than the inner diameter of the hole formed in the roller 222. Herein, the upper end of the roller coupling portion 221 provided with at least two protrusions may be bent inward of the roller coupling portion 221. The roller coupling portion 221 may be inwardly bent. Once the upper end of the roller coupling portion 221 passes through the hole formed in the roller 222, it may recover the original shape thereof. In this way, the roller 222 may be mounted so as not to be separated from the roller coupling portion 221.

A fixing part 223 may be formed on one surface of the body 220 of the roller bracket 22 in a protruding manner. A fixing hole 251 may be formed in the support bracket 25, and the fixing part 223 of the roller bracket 22 may be fitted into the fixing hole 251 of the support bracket 25. Thereby, the support bracket 25 may be fixed to the roller bracket 22.

One surface of the body 220 of the roller bracket 22 may be provided with an interference part 224. The interference part 224 may be provided on the one surface of the body 220 on which the fixing part 223 is formed. The support bracket 25 may be provided with a curved part 252 bent and extending from a connection body 250, and the fixing hole 251 may be formed in the curved part 252. When the fixing part 223 is inserted into the fixing hole 251, the curved part 252 is interfered with the interference part 224. Thereby, separation between the roller bracket 22 and the support bracket 25 may be prevented.

Specifically, when the fixing part 223 is inserted into the fixing hole 251, movement of the support bracket 25 in the x-axis direction may be interfered with by the fixing part 223 of the roller bracket 22, and movement of the support bracket 25 in the y-axis direction may be interfered with by the interference part 224. Thereby, the fixing part 223 of the roller bracket 22 may be held fitted into the fixing hole 251 formed in the support bracket 25.

The support bracket 25 includes a connection body 250, a curved part 252 bent and extending from one side of the connection body 250, and a connection part 253 formed at the opposite side of the connection body 250. A fixing hole 251 allowing the fixing part 223 of the roller bracket 22 to be inserted thereinto may be formed in the curved part 252. The curved part 252 is interfered with by the interference part 224 formed at the roller bracket 22, and thus separation between the roller bracket 22 and the support bracket 25 may be prevented.

A wire insertion hole 253 may be formed in the connection part 253. The wire divider 23 may be held inserted into the wire insertion hole 253.

In this way, the wire divider 23 and the roller bracket 22 may be connected to each other by the support bracket 25.

At least one wire divider 23 may be provided. For example, the wire divider 23 may include a first wire divider 23*a* and a second wire divider 23*b*. Herein, the first wire divider 23*a* and the second wire divider 23*b* may intersect. For example, the first wire divider 23*a* may be positioned in the case 21 so as to extend in the x-axis direction, and the second wire divider 23*b* may be positioned in the case 21 so as to extend in the y-axis direction.

In the case that the first wire divider 23*a* and the second wire divider 23*b* intersect, a grip 26 may be arranged at the point of intersection between the first wire divider 23*a* and the second wire divider 23*b*. The user may move the first wire divider 23*a* and the second wire divider 23*b* by manipulating the grip 26.

The grip 26 may include a first body 260 and a second body 261. The first body 260 and the second body 261 may be provided such that a first hole 262 allowing the first wire divider 23*a* to pass therethrough and a second hole 263 allowing the second wire divider 23*b* to pass therethrough are formed when the first body 260 and the second body 261 are coupled to each other. The first hole 262 and the second hole 263 may be spaced apart from each other while penetrating the grip 26.

For example, a part of the first hole 262 and a part of the second hole 263 may be formed in the first body 260, and the other part of the first hole 262 and the other part of the second hole 263 may be formed in the second body 261. Thereby, when the first body 260 and the second body 261 are coupled to each other, the first hole 262 and the second hole 263 may be formed.

To couple the first wire divider 23*a* and the second wire divider 23*b* to the grip 26, the first wire divider 23*a* is first positioned at the position of the first hole 262 on the first body 260. The second wire divider 23*b* is positioned at the position of the second hole 263 on the first body 260. After the first wire divider 23*a* and the second wire divider 23*b* are positioned as above, the second body 261 may be coupled to the first body 260. Thereby, the first wire divider 23*a* and the second wire divider 23*b* may mounted by being inserted into the grip 26.

A cap 264 may be provided to the upper portion of the grip 26. By providing the cap 264, aesthetics of the external appearance of the grip 26 may be improved. The cap 264 may be formed of a material producing large frictional force to allow the user to readily manipulate the grip 26.

Figure 8:
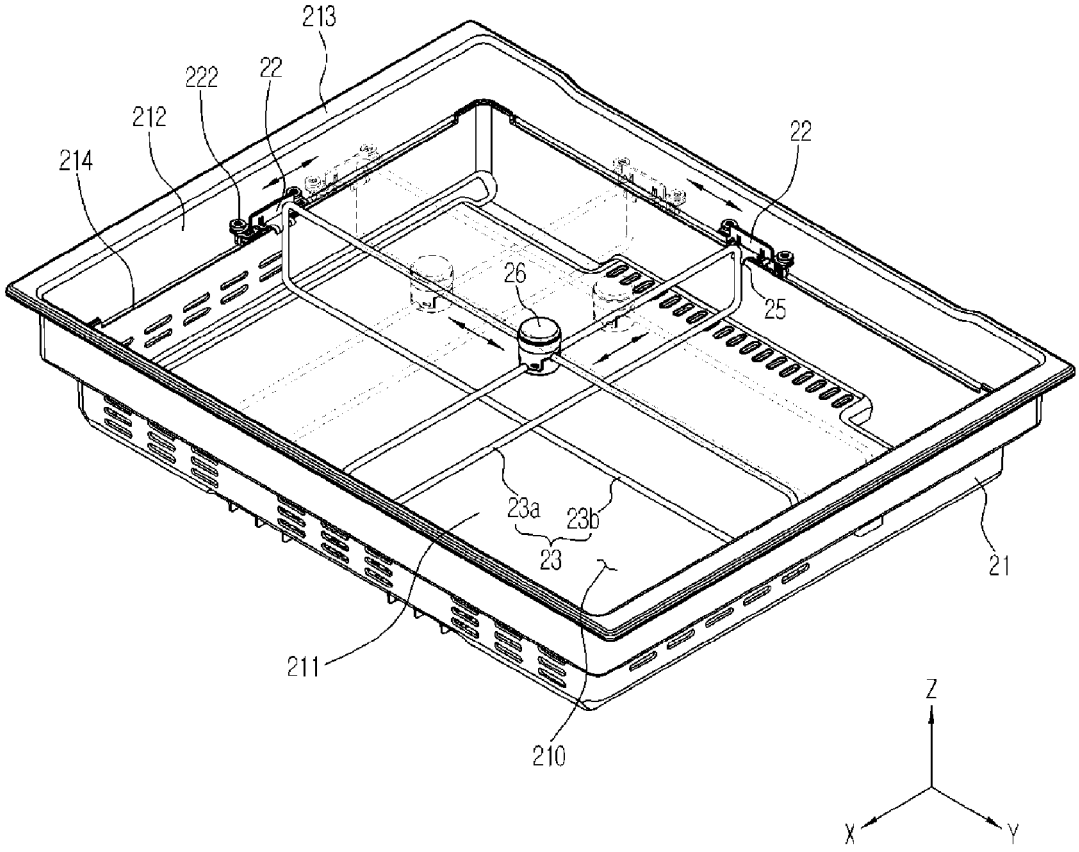
FIG. 8 is a view illustrating movement of a wire divider provided in a food container according to one embodiment of the present disclosure.

FIG. 8 is a view illustrating movement of a wire divider provided in a food container according to one embodiment of the present disclosure.

Referring to FIG. 8, a wire divider 23 according to one embodiment of the present disclosure includes a first wire divider 23*a* and a second wire divider 23*b* which intersect each other. The wire divider 23 may be positioned in the accommodation space 210 of the case 21. The first wire divider 23*a* may be arranged to move in a direction in which the second wire divider 23*b* extends. Similarly, the second wire divider 23*b* may be arranged to move in a direction in which the first wire divider 23*a* extends.

The first wire divider 23*a* may extend in the x-direction, and the second wire divider 23*b* may extend in the y-direction. The user may move the first wire divider 23*a* in the y-direction by manipulating the grip 26 mounted at the point of intersection between the first wire divider 23*a* and the second wire divider 23*b*. The user may move the second wire divider 23*b* in the x-direction by manipulating the grip 26.

At this time, the roller 222 mounted to the roller bracket 22 may slide along the stepped portion 214 provided to the inner sidewall 212 of the case 21 by rolling. Thereby, the user may divide and use the space in the food container 20 as desired. In addition, when necessary, the user may remove the divider assembly after separating the cover 24 from the case 21.

As the stepped portion 214 is provided inside the case 21 of the food container 20 and the divider assembly is arranged to slide along the stepped portion 214, the number of components of the food container 20 with the divider assembly may be reduced and cost reduction may be achieved, compared to a conventional food container 20 having a separate rail unit allowing the divider assembly to slide thereon. Through the configuration as above, the space in the food container 20 may be freely adjusted as desired.

As is apparent from the above description, according to an embodiment of the present disclosure, a stepped portion formed at an inner sidewall of a food container, allowing a roller bracket connected to a wire divider to slide on the stepped portion. Thereby, a sliding structure of a divider assembly may be easily implemented. As the wire divider is arranged to freely partition the inner space of the food container to allow a user to partition and use the inner space of the food container as desired, convenience in using the food container may be enhanced.

Although a few embodiments of the present disclosure have been shown and described, it would be appreciated by those skilled in the art that changes may be made to the embodiments without departing from the principles and spirit of the invention, the scope of which is defined in the claims and their equivalents.

What is claimed is:

1. A food container comprising:

a case defining an accommodation space therein, an inner surface of the case being provided with a stepped portion;

a divider assembly to partition the accommodation space as desired, the divider assembly having one side slidably seated on the stepped portion; and a cover provided to an upper portion of the case, wherein the divider assembly comprises at least one wire divider to partition the accommodation space;

a roller bracket provided with a plurality of rollers directly seated on the stepped portion to slide to allow movement of the wire divider; and a support bracket to connect the roller bracket to the wire divider, wherein the plurality of rollers are downwardly constrained by only the stepped portion and upwardly constrained by only the cover.

2. The food container according to claim 1, wherein the at least one wire divider comprises a plurality of wire dividers intersecting each other.

3. The food container according to claim 2, wherein the at least one wire divider comprises two wire dividers intersecting each other, the two wire dividers being individually movable.

4. The food container according to claim 3, wherein a grip is provided at a point of intersection between the two wire dividers.

5. The food container according to claim 4, wherein the two wire dividers are spaced apart from each other and mounted to the grip such that the two wire dividers are individually movable through manipulation of the grip.

6. The food container according to claim 5, wherein the grip comprises:

a first body provided with a portion of a hole allowing the wire dividers to be inserted thereinto; and a second body coupled to the first body and provided with the other portion of the hole allowing the wire dividers to be inserted thereinto.

7. The food container according to claim 6, wherein an upper portion of the grip is provided with a cap formed of a material producing large frictional force.

8. The food container according to claim 1, wherein the roller bracket is provided with a fixing part protruding therefrom, and the support bracket is provided with a fixing hole, wherein the support bracket is mounted to the roller bracket by inserting the fixing part into the fixing hole.

9. The food container according to claim 8, wherein the roller bracket is provided with an interference part, wherein one side of the support bracket is interfered with by the interference part such that the support bracket and the roller bracket are not separated from each other.

10. The food container according to claim 9, wherein a curved part is formed at one side of the support bracket, and the fixing hole is formed in the curved part, wherein the curved part is interfered with by the interference part.

11. The food container according to claim 10, wherein a wire insertion hole is formed at the other side of the support bracket, wherein the wire divider is fixed through insertion into the wire insertion hole.

12. The food container according to claim 1, wherein the cover is detachably provided to the upper portion of the case.

13. A refrigerator comprising:

a drawer type door adapted to be withdrawn forwardly;

a basket connected to the drawer type door to be withdrawn when the drawer type door is withdrawn;

a food container accommodated in the basket, an inner sidewall of the food container being provided with a stepped portion; and a divider assembly accommodated in the food container to freely partition an inner space of the food container as desired by sliding with one side thereof seated on the stepped portion, wherein the divider assembly comprises at least one wire divider arranged across the inner space of the food container to partition the inner space of the food container; and a roller bracket connected to the wire divider and provided with a roller coupling portion protruding from the roller bracket and allowing a roller to be rotatably mounted thereto, the roller being configured to move directly along the stepped portion by rolling such that the wire divider is moved, wherein a grip is arranged at a point of intersection of the at least one wire divider, the grip being configured to be manipulated to move the wire divider within the food container.

14. The refrigerator according to claim 13, wherein the at least one wire divider comprises two wire dividers positioned to intersect each other, wherein one of the two wire dividers is arranged to move in a direction of extension of the other one of the wire dividers.

15. A refrigerator comprising:

a body provided with a food storage space; and a container provided within the food storage space, wherein the container includes a quadrangular bottom surface and sidewalls extending from the bottom surface, a stepped portion being formed on inner surfaces of the sidewalls;

a divider assembly to variably partition an inner space of the container, the divider assembly including two wire dividers arranged across the inner space arranged approximately perpendicular to each other, rollers connected to each end of the wire dividers and configured to directly roll along the stepped portion to move the respective wire divider, and a grip arranged at a point of intersection of the wire dividers.

16. The refrigerator according to claim 15, wherein the grip comprises:

a first body provided with a portion of a hole allowing the wire dividers to be inserted thereinto; and a second body coupled to the first body and provided with the other portion of the hole allowing the wire dividers to be inserted thereinto.

17. The refrigerator according to claim 16, wherein an upper portion of the grip is provided with a cap formed of a material producing large frictional force.

* * * * *